United States Patent [19]

Kalleberg

[11] Patent Number: 4,816,152

[45] Date of Patent: Mar. 28, 1989

[54] SEPARATOR FOR SEPARATING A MIXTURE OF TWO LIQUIDS HAVING DIFFERENT SPECIFIC WEIGHTS

[76] Inventor: Jacob Kalleberg, Dalbolia 3, N-4600 Kristiansand S, Norway

[21] Appl. No.: 1,324

[22] Filed: Jan. 7, 1987

[30] Foreign Application Priority Data

Jan. 15, 1986 [NO] Norway ..... 860122

[51] Int. Cl.[4] ..... B04B 1/04

[52] U.S. Cl. ..... 210/360.2; 210/369; 210/381; 494/38; 494/80

[58] Field of Search ..... 210/360.1, 360.2, 369, 210/377, 378, 380.1, 381; 494/80, 56, 38, 27

[56] References Cited

U.S. PATENT DOCUMENTS

| | | | |
|---|---|---|---|
| 2,646,921 | 7/1953 | Adams et al. | 494/75 |
| 3,208,201 | 9/1965 | Oliver, III | 494/27 |
| 3,442,445 | 5/1969 | Rydberg et al. | 494/56 |
| 3,674,206 | 7/1972 | Wendt, Jr. | 494/56 |
| 4,067,494 | 1/1978 | Willus et al. | 494/65 |

FOREIGN PATENT DOCUMENTS

| | | |
|---|---|---|
| 44053 | 12/1916 | Norway . |
| 105318 | 2/1917 | United Kingdom . |

*Primary Examiner*—Benoit Castel
*Assistant Examiner*—Richard D. Jordan
*Attorney, Agent, or Firm*—Ladas & Parry

[57] ABSTRACT

A separator for separating a mixture of two liquids having different specific weights has a transverse wall between upper and lower exterior casing portions having axial openings at opposite axial ends, the axial opening in the upper casing portion having a larger effective diameter than the axial opening in the lower casing portion. An interior casing is spaced inside the upper casing portion and has an upper end. There are at least two openings through the transverse wall, one opening communicating from inside the lower casing portion to the space between the upper casing portion and the interior casing and the other opening being radially inward thereof for communicating between the interior casing and the lower casing portion. An inlet into the upper end of the interior casing lets the mixture into the interior casing while rotating the transverse wall, casing portions and interior casing.

10 Claims, 1 Drawing Sheet

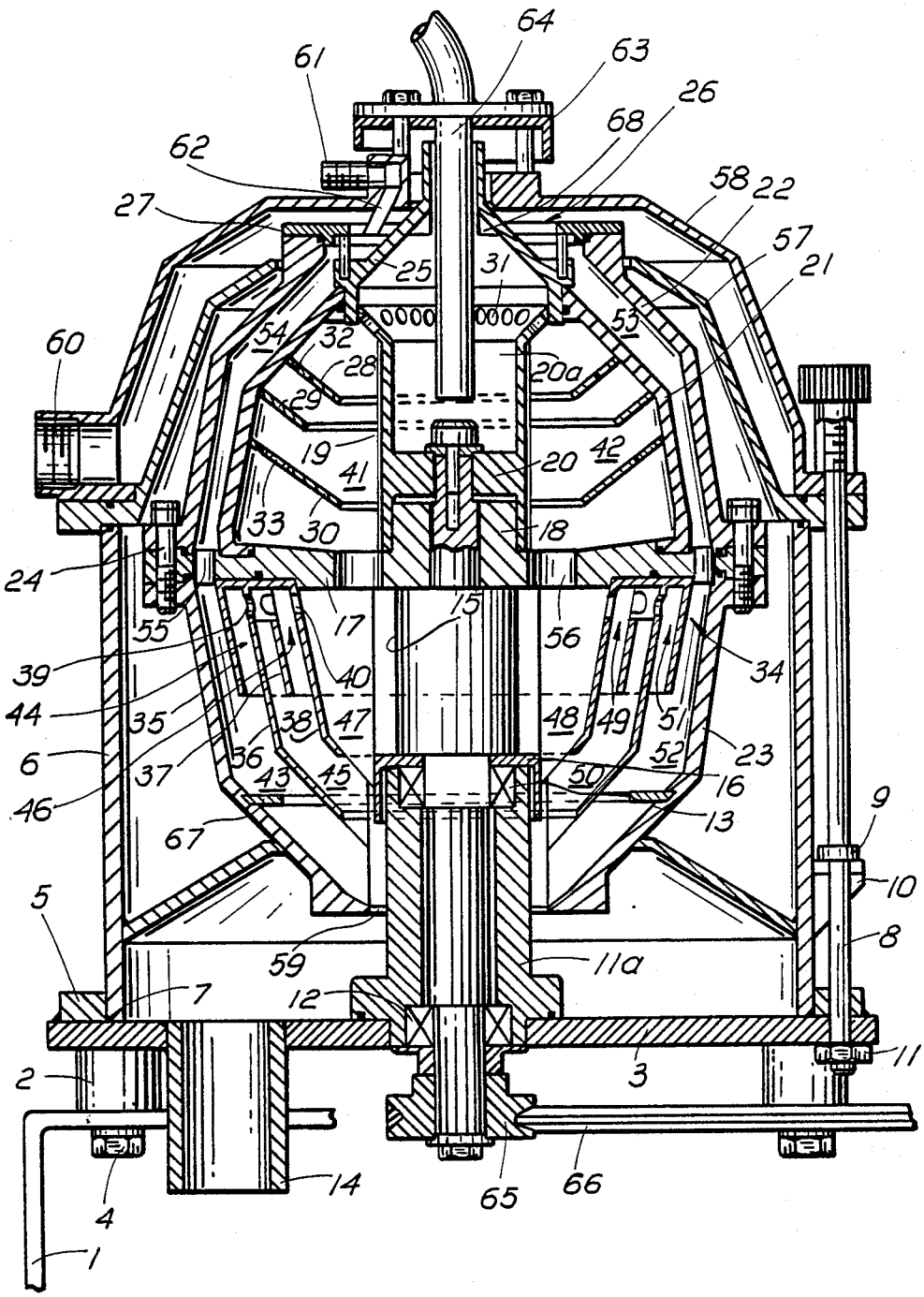
64
63
61
26
68
62
58
22
27
57
21
25
31
53
60
54
32
28
20a
29
19
20
42
41
33
30
18
24
15
17
56
55
34
39
40
44
35
38
47
48
49
51
23
6
37
36
52
43
45
50
16
46
13
9
67
10
5
8
59
11a
7
12
11
2
3
14
65
66
4
1

SEPARATOR FOR SEPARATING A MIXTURE OF TWO LIQUIDS HAVING DIFFERENT SPECIFIC WEIGHTS

BACKGROUND OF THE INVENTION

The invention relates to a separator for separating a mixture of two liquids having different specific weights, e.g. water and oil.

There is a demand for a separator for separating a mixture of two liquids having different specific weights. A typical example of such a mixture is water contaminated with oil. Separating the water from the oil would be useful, for example, on board ships and offshore installations.

SUMMARY OF THE INVENTION

This is an object of the invention.

To this end, a mixture of two liquids having different specific weights is subjected to centrifugal forces for considerably increasing the difference of weight for separation of the two, mixed liquids. The invention, based on this principle, uses centrifugal forces to form liquid annuluses on both, opposite sides of a wall transverse to the rotational axis of the liquid annuluses, the mixture of liquids being fed to the liquid annulus on one, upper side of said wall, and the liquid from the liquid annulus on the opposite, lower side of said wall passing through different radii openings at the opposite axial ends of said liquid annuluses. In the case of water contaminated with oil, the oil will collect on the radially inside surfaces of said liquid annuluses, and it will flow out through the "higher", i.e. radially smaller axial end opening, whereas pure water will flow out through the opposite "lower", i.e. radially larger axial end opening.

According to the invention, therefore, a separator for separating a mixture of two liquids having different specific weights, e.g. water contaminated with oil, has a rotatable casing with an opening at each axial end, one opening having a larger radius than the other, and a transverse wall in said casing.

DESCRIPTION OF A PREFERRED EMBODIMENT

The invention will now be disclosed in more detail with reference to the drawing showing a sectional view of a preferred embodiment of a separator according to the invention.

The separator shown in the drawing is intended for purification of oil containing water.

Rubber pads 2 on a base 1 support one side of a base plate 3. Base plate 3 is secured to the base 1 with screws 4. On the other, top side of the base plate, a ring 5 is secured by welding. Within said ring 5 is a mantle 6 with an O-ring 7 between the ring and mantle. Mantle 6 is attached to the base plate 3 by tie-rods 8. Each tie-rod (only one is shown) has a collar 9 in contact with a bracket 10 on the mantle. A nut 11 tensions the tie-rod to press collar 9 against the bracket 10 and, thus, keep the mantle 6 in place on the base plate 3.

Base plate 3 has a central opening wherein a bearing casing 11*a* with a lower bearing 12 and an upper bearing 13 is provided. An outlet 14 for oil is also provided in the base plate 3.

A separator shaft 15 is mounted in the two bearings 12 and 13 of the bearing casing 11a. As shown, the separator shaft is stepped at the upper bearing 13, and between the thicker, stepped portion of the separator shaft above the upper bearing 13 and the upper bearing 13 is an ejector 16.

At the other uppermore end of the thicker portion of the separator shaft is transverse wall 17. It has a central boss 18 surrounding an uppermost thinner portion of the separator shaft. On the boss 18, a cylindrical device 19 with a transverse, interior wall 20 is mounted. The upper portion of the cylindrical device 19 thus forms a cup shaped compartment 20*a*.

On one, upper side of the transverse wall 17, a generally conical interior casing 21 is mounted, and spaced outside said casing, but also on the transverse wall 17, an upper exterior casing portion 22 is mounted. Correspondingly to the latter, the opposite, lower side of the transverse wall 17 is provided with an exterior lower casing portion 23. Said casing portions 22 and 23 together form a casing for the separator. As shown, said two casing portions 22, 23, and said transverse wall 17 are held together by screw bolts 24.

The convergent top of the generally conical interior casing 21 has an inverted inlet hoper 25, which is also on the cylindrical device 19. Said inlet hopper 25 may be integral with the cylindrical device 19, but is preferably a separate member connected thereto.

Said upper exterior casing portion 22 has an uppermost axial opening at 26 with a so-called specific weight ring 27. Said specific weight ring is a plate ring. Its selection varies the effective cross section of the opening 26 of the upper exterior casing, i.e. the cross section of the actual opening at axial opening 26 may be varied by exchanging one specific weight ring for another having a different opening. Said specific weight ring is screwed onto the top of the exterior casing portion 22.

Inside the generally conical interior casing 21 are oppositely oriented conical members 28, 29, 30. The cylindrical device 19 has a conical transition area between its cylinder and the inlet hoper 25 with openings 31. The conical member 28 and 30 have further openings 32, 33 close to the internal wall of the conical interior casing 21, and said conical members are, thus, called conical guide cups. Conical member 29 is called a diverting conus. In the drawing, only two openings 32 and 33, respectively, are shown, but there are a number of them, in the same manner as shown for openings 31.

In said lower exterior casing portions 23, an insert 34 which comprises several conical members 35, 36,37, and 38 is provided on the lower side of the transverse wall 17. Adjacent the lower side of the transverse wall 17 are openings 39, 40 in the conical members 36 and 38, and said members can be, thus, called conical guide cups, whereas conical members 35 and 37 can be called diverting conuses. The reason for choosing these designations will appear from the following disclosure of the operation of the separator.

All the guide-cup and conus conical members 28, 29, 30, 35, 36, 37 and 38 support respective, plural, circumferentially spaced radial walls 41 to 52 as impeller plates. Between interior casing 21 and exterior casing portion 22 are further circumferentially spaced, impeller-plate radial walls 53, 54. The number of radial walls about these may vary, two each being shown in the section of the drawing, but commonly, four radial walls or impeller plates are uniformly distributed thereabout. The larger the cross section of the separator, the larger the number of radial walls or impeller plates needed.

The transverse wall 17 has plural openings 55 and 56 therethrough at its central boss 18 and between the interior casing 21 and exterior casing portion 22, respectively, as shown. Openings 56 form a connection between a preliminary separation compartment formed by the interior casing 21 and a final separation compartment formed by the lower exterior casing portion 23, whereas openings 55 make the space between the interior casing 21 and the upper exterior casing portion 22 with the radial walls 53, 54 into peripheral axial flow passages between the final separation compartment of the lower exterior casing portion 23 and the axial end opening 36 in the upper exterior casing portion 22. An opposite axial end opening 59 in the lower exterior casing portion 23 has a diameter smaller than that of the axial end opening 26 in the upper exterior casing portion 22. The difference between these diameters, which is important to operation of the separator, as described below, is adjusted by exchanging the specific weight ring 27, as described above.

An interior cover 57 and, spaced therefrom, an exterior cover 58 are provided on the mantle 6, which is stationary. Said covers, as shown, are kept in place by nuts 8' on tie-rods 8. The exterior cover 58 is provided with an outlet member 60 for pure water. On top of the exterior cover 58, an inlet member 61 for pure water is provided. Said inlet member is connected with a pipe 62 extending into said axial opening 26 for supplying the pure water to the space between the interior casing 21 and the exterior casing portion 22.

The exterior cover 58 is, further, provided with a screen 63 having an inlet pipe 64 for water having an oil content. Inlet pip 64 extends, as shown, into the inverted inlet hoper 25 and the cup-shaped compartment 20*a*.

A V-belt pulley 65 is mounted on the lower end of the separator shaft 15, which end depends from the base plate 3. Shaft 15 and associated components may be rotated by a motor, not shown, with a V-belt 66 between the motor and the V-belt pulley 65.

The separator operates in the following manner:

The separator is started when shaft 15 is rotated by the V-belt drive 65, 66. Pure water is then introduced through inlet member 61 and pipe 62. It builds up a water lock in the shape of a pure water annulus on the insides of the exterior casing portions 22, 23. The build up of said water lock is complete when water flows out across the rim ring 27 of the axial opening 26. The object of said water lock is to prevent any oil residues in the separator from being pushed into the outlet member 60 for pure water.

Then water contaminated with oil (e.g. from an oil boom) is introduced into said separator through inlet pipe 64. Advantageously, a slow-running lamella pump, geared pump, or screw pump is used for this so as not to agitate the water/oil mixture too much. Because the inlet pipe 64 extends down into the cup-shaped compartment 20*a* of cylinder device 19, the contaminated water is received in the separator in a gentle manner, to prevent formation of emulsions and even the beginning formation of emulsions, as it begins to rotate with the cylinder device 19 and a certain liquid pressure is built up. This forces the liquid out through the openings or holes 31.

In order to ensure that the liquid does not work it way out to screen 63, impeller plates 68 are provided inside the upper end of the inverted inlet hopper 25 at the inlet pipe 64. If the level of liquid in the cup-shaped compartment 20*a* of the cylinder device 19 and the inlet hopper 25 gets too high and to this zone (e.g. due to exceeding the contaminated water inlet capacity of the separator) the liquid reaching the impeller plates 68 is rotated by the impeller plates 68 and thus forced down the inlet hopper and out through the holes or openings 31.

From the openings 31, the liquid mixture passes into the interior casing 21 where the conical members 28, 29 and 30 promote preliminary separation of its oil and water constituents. With rotation of the mixture by the plates 41, 42, the heavier water particularly tends to flow outwards, and some oil will, naturally, be taken along. This liquid will pass through openings 32 in the uppermost conical member 28, which then acts as a guide cup, because any oil taken along tends to rise to the underside of the member 28. Additional liquid mixture flows down and past the inner end rim of member 28, which subjects it to a separating effect of flow direction change toward member 29. The liquid from openings 32 flowing along member 29 is severely deflected at the inner rim of said member and, thus, such a member is called a diverting conus. The liquid then flows on downwards past conical member 30 in a similar manner to that described for similar member 28 and, finally, passes through apertures 56 in the transverse wall 17 and into the lower casing portion 23. In the preliminary separating compartment, i.e. the interior casing 21, the preliminary separation has made the oil particles in the original mixture coalesce into larger drops or even a real oil flow. In this separation step the oil is brought "up to the surface", i.e. displaced radially inward by opposite centrifugal action on the heavier water, as quickly as possible so that any precipitation of solids is prevented.

In lower casing portion 23, the heavier water still tends to flow centrifugally outwards, whereas the oil will tend to flow inwards and downwards towards outlet opening 59. In the upwardly divergent, generally conical exterior casing portion 23, this drives the water upwards towards opening 26 through the outermore apertures 55 in the transverse wall 17. In the lower casing portion 23, the conical members 35, 36, 37 and 38 contribute to the above-resulting, desired separation, because the oil always tends to flow towards the "surface", i.e. radially inwards, and down towards outlet opening 59. The reason why water will tend to flow towards opening 26 is that an "overpressure" is built up, i.e. there is a difference of radius which, by centrifugal action, is the effective height between the inner overflow rim of ring 27 at opening 26 and the outer rim of opening 59. The separator thus has to receive a volume of liquid sufficient to reach the rim around opening 59. The difference of effective heights is, thus, the difference between the radii of opening 59 and ring 27.

If the capacity of the separator is exceeded, water will flow out the opening 59 with the oil. The pure water from opening 26 will, thus, not be contaminated.

Separation is completed in the lower casing portion 23 with the guide cups 36 and 38 and diverting conuses 35 and 37. These produce an almost axial flow of the liquid with the liquid being subjected to increasing centrifugal forces as it flows outwards.

In the embodiment shown, there are two steps, each step being one guide cup 36 or 38 and one diverting conus 35 or 37. In larger separators, a larger number of steps may be used, i.e. as many steps as practical for the space. These produce liquid flow alternately upwards and downwards, the small oil particles can more easily break away as the water flow is so deflected as it passes towards outlet 36. These also produce a longer flow path towards the outlet 26. Thus, a longer period for separation in achieved.

Finally, pure water will rise up between the outermost conical member 35 and lower exterior casing portion 23, pass through openings 55, rise further upwards along the upper exterior casing portion 22, and exit through the axial opening 26 into outlet member 60. Separated oil, however, will gradually build up in a layer on the centrifugally produced, axial surface of the water and flow out through axial end opening 59 and oil outlet member 14.

As mentioned, there are radial impeller plates between the conical members and between the interior casing 21 and upper exterior casing portion 22. These are primarily necessary to keep the mixture of oil and water rotating to ensure maximum centrifugal effect across all diameters. They also contribute to maintaining a stable annulus of water and oil to keep everything in balance.

Specific weight ring 27 may be exchanged because its opening diameter is important to operation. The radial depth of the innermore, annular oil layer can increase with the specific weight of the oil, and if the opening of specific weight ring is too large, and the oil has too high a specific weight, oil might pass into the passage for pure water. If the diameter of specific weight ring is too small, however, the separating capacity of the separator is unnecessarily reduced.

When a separation operation is finished, the separator rotation is stopped. When the casing portions 22, 23 are at a standstill, water and oil residues will flow out through openings 55, 56 and 59 and outlet 14. As shown, the top side of plate 17 is conical. This will facilitate an outward flow of any solids and mud during stillstand. Since the water mixture is separated in a cold state, only loose coats of these are formed during separation, and most of these will so drain out of the separator during stillstand. However, there may often remain a certain fatty coat. This is the reason for providing the water seal from the separate inlet devices 61, 62, which lifts such possible fatty residues radially inwards towards the centrifugal surface, instead of forcing them out with the pure water. Also, any lowermore oil residues on the lower exterior casing portion 23 when the separator is started will be caught by a catch ring 67.

Before separation is stopped, a period of separator rotation with pure water (preferably, exceeding the capacity of the separator) will also have a cleansing effect, any possible oil residues then to a certain degree being flushed out by pure water. Hot water will be especially efficient. Also, the inner parts of the separator should have a smooth surfaces as possible.

Having described my invention, I claim:

1. A separator for separating a mixture of two liquids having different specific weights, comprising:

a transverse wall;

upper and lower exterior casing portions respectively having axial ends on opposite sides of the transverse wall and axial openings at the opposite axial ends, the axial opening in the upper casing portion having a larger effective diameter than the axial opening in the lower casing portion;

an exterior casing spaced inside the upper casing portion and having one axial end on the same side of the transverse wall as the upper casing portion and an opposite, upper end;

upper conical members inside the interior casing having bases axially spaced therealong and tapering to ends thereof towards the transverse wall, the bases of the upper conical members having openings therethrough;

at least two openings through the transverse wall, one opening communicating from inside the lower casing portion to the space between the upper casing portion and the interior casing and the other opening being radially inward thereof for communicating between the interior casing and the lower casing portion;

inlet means into the upper end of the interior casing for letting a mixture of two liquids having different specific weights into the interior casing; and rotation means for axially rotating the transverse wall, casing portions and interior casing, whereby the centrifugal force of the rotation forms a liquid annulus in the interior casing and causes the one of the liquids with the lower specific weight to tend to separate radially inwardly thereof as the liquids flow downwardly to the radially innermore of the openings through the transverse wall and into the lower casing portion; and forms a liquid annulus in the lower casing portion, causes the one liquid to separate further radially inwardly as the one liquid flows downwardly to and through the axial opening in the lower casing portion, and forces the other liquid radially outwardly, and up through the other of the openings through the transverse wall and the space between the upper casing portion and interior casing to and through the axial opening in the upper casing portion.

2. The separator as defined in claim 1, wherein the inlet means comprises an inverted hopper connected to the upper end of the interior casing for providing an axial chamber for receiving the mixture, and wherein the radially innermore opening through the transverse wall is coaxial with the axial openings of the upper and lower casing portions.

3. The separator as defined in claim 2, and further comprising a stationary inlet pipe having an open end for supplying the mixture, and wherein the inverted hopper has an upper portion extending upwardly coaxially through the axial opening of upper casing portion for receiving the inlet pipe at the open end thereof.

4. The separator as defined in claim 3, and further comprising a cup shaped member connected to a lower portion of the inverted hopper for receiving the open end of the inlet pipe.

5. The separator as defined in claim 3, and further comprising radial impeller plates about the inverted hopper at the upper portion thereof.

6. The separator as defined in claim 1, and further comprising at least two, radially spaced, lower conical members inside the lower casing portions having bases on the same side of the transverse wall as the axial end of the lower casing portion thereon and tapering toward the axial opening of the lower casing portion, the radially innermore of the lower conical members having at least one opening therethrough in proximity to the transverse wall, the opening through the transverse wall being on opposite radial sides of the bases of the lower conical members thereon.

7. The separator as defined in claim 6, and further comprising at least one radial plate on the lower conical members for impelling the liquids in the lower casing portion into rotation therewith.

8. The separator as defined in claim 1, and further comprising liquid seal means for supplying a liquid to the space between the upper casing portion and interior casing from the axial opening of the former.

9. The separator as defined in claim 1, and further comprising stationary blocking screen means at the axial opening of the upper casing portion for preventing contact with the rotation of the latter.

10. The separator as defined in claim 1, wherein the ends of axially alternate ones of the upper conical members are radially innermore, and the bases of the alternate upper conical members with the radially innermore ends have the openings therethrough.

* * * * *